US006206074B1

(12) United States Patent
Liu

(10) Patent No.: US 6,206,074 B1
(45) Date of Patent: Mar. 27, 2001

(54) ADJUSTABLE BRACKET FOR DECORATIVE FINIAL

(76) Inventor: Armin Liu, 2411 San Diego Ct., Claremont, CA (US) 91711

( * ) Notice: Subject to any disclaimer, the term of this patent is extended or adjusted under 35 U.S.C. 154(b) by 0 days.

(21) Appl. No.: 09/535,253

(22) Filed: Mar. 23, 2000

(51) Int. Cl.[7] ..... E06B 9/00
(52) U.S. Cl. ..... 160/38; 160/349.2; 248/262
(58) Field of Search ..... 160/19, 38, 39, 160/349.2; 248/262, 265; 428/28; 40/622

(56) References Cited

U.S. PATENT DOCUMENTS

| | | | | |
|---|---|---|---|---|
| 4,079,770 | * | 3/1978 | Woodle | 160/19 |
| 4,399,856 | | 8/1983 | Anderson . | |
| 4,559,988 | | 12/1985 | Nocerino . | |
| 4,662,421 | | 5/1987 | Basmadji et al. . | |
| 5,417,271 | | 5/1995 | Fenley . | |
| 5,544,692 | | 8/1996 | McMichael . | |
| 5,615,721 | | 4/1997 | Winter . | |
| 5,896,909 | | 4/1999 | Sartini . | |
| 5,975,184 | | 11/1999 | Nien et al. . | |

FOREIGN PATENT DOCUMENTS

| | | | | |
|---|---|---|---|---|
| 484783 | * | 10/1929 | (DE) | 160/19 |
| 2237455 | * | 2/1974 | (DE) | 160/38 |

* cited by examiner

*Primary Examiner*—Blair M. Johnson
(74) *Attorney, Agent, or Firm*—Marcia Devon; Chan Law Group LC

(57) ABSTRACT

An adjustable finial mounting bracket apparatus generally comprising a first bracket, a firs t flange, a second bracket, a second flange, a knob, and a screw. The first flange and second flange extend outwardly from the first bracket and the second bracket, respectively, and are adapted to engage the lips of a headrail for a curtain or drapery. The first bracket and the second bracket abut each other and are attached together by a screw. Each bracket is adapted to longitudinally move with respect to the other, thereby providing the adjustment capability for attachment onto headrails of varying sizes. The surfaces of both the first bracket and the second bracket are corrugated so that detent movement is provided when sliding first bracket relative to second bracket, and greater holding strength of the apparatus on the headrail is achieved when the screw is tightened.

5 Claims, 3 Drawing Sheets

ADJUSTABLE BRACKET FOR DECORATIVE FINIAL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to curtain draping hardware, and more particularly, to an adjustable bracket assembly capable of being mounted onto a variety of headrails having different sizes.

2. Description of the Background Art

Use of curtains, draperies, miniblinds, or the like are commonplace in homes and businesses alike. These curtains, draperies, or miniblinds are hung from a location above the window opening and suspended vertically therefrom. Often decorative accents, such as finials, are used as finishing touches for interior decoration. The finials can be found attached to the curtain rod, or even the miniblinds and draperies themselves. The drawback to attaching finials to the curtain rods is that movement and positioning of the drapery becomes severely limited. Alternatively, attaching the finials to the miniblinds or draperies themselves have drawbacks such that the finial would move along with the miniblind or drapery, and ultimately may not necessarily rest in a position that is desired. Moreover, the curtain or drapery cannot be suspended over and behind the finial when it is mounted either onto the curtain or drapery itself or even the curtain rod.

Horizontally disposed rods, typically known as curtain rods, are used to support these curtains, draperies, or miniblinds, which allow for opening or closing the same by sliding horizontally along the rod. Due to their functional nature, these curtain rod arc not necessarily aesthetically appealing, and thus, are covered by a headrail that is also suspended horizontally above the window. These headrails provide suitable attachment points for finials, which would eliminate the aforementioned drawbacks of attaching finials to either the curtain rod or the drapery or miniblind. Headrails, however, come in varying sizes to accommodate the many functional requirements and individual tastes, and therefore, individually sized brackets are required.

Accordingly, there exists a need for mounting a decorative finial onto a headrails of varying sizes and without the aforementioned disadvantages. The present invention satisfies this need, as well as others, and generally overcomes the aforementioned deficiencies and disadvantages.

BRIEF SUMMARY OF THE INVENTION

The present invention pertains to an adjustable finial mounting bracket apparatus adapted for attachment onto a headrail for a curtain or miniblind.

By way of example and not of limitation, the adjustable finial mounting bracket apparatus of the present invention comprises a first bracket, a first flange, a second bracket, a second flange, a knob, and a screw. The first flange and second flange extend outwardly from the first bracket and the second bracket, respectively, and are adapted to engage the lips of the headrail. The first bracket and the second bracket abut each other and are attached together by a screw. Each bracket is adapted to longitudinally move with respect to the other, which provides the adjustment capability for attachment onto headrails of varying sizes. The surfaces of both the first bracket and the second bracket are corrugated so that detent movement is provided when sliding first bracket relative to second bracket, and greater holding strength is achieved in the apparatus against the headrail when the screw is tightened.

An object of the invention is to provide an apparatus for mounting a decorative finial onto a drapery or curtain headrail.

Another object of the invention is to provide a finial mounting bracket that is adjustable to accommodate a variety of headrails.

Still another object of the invention is to provide an apparatus for supporting a drapery or curtain that is draped thereover.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
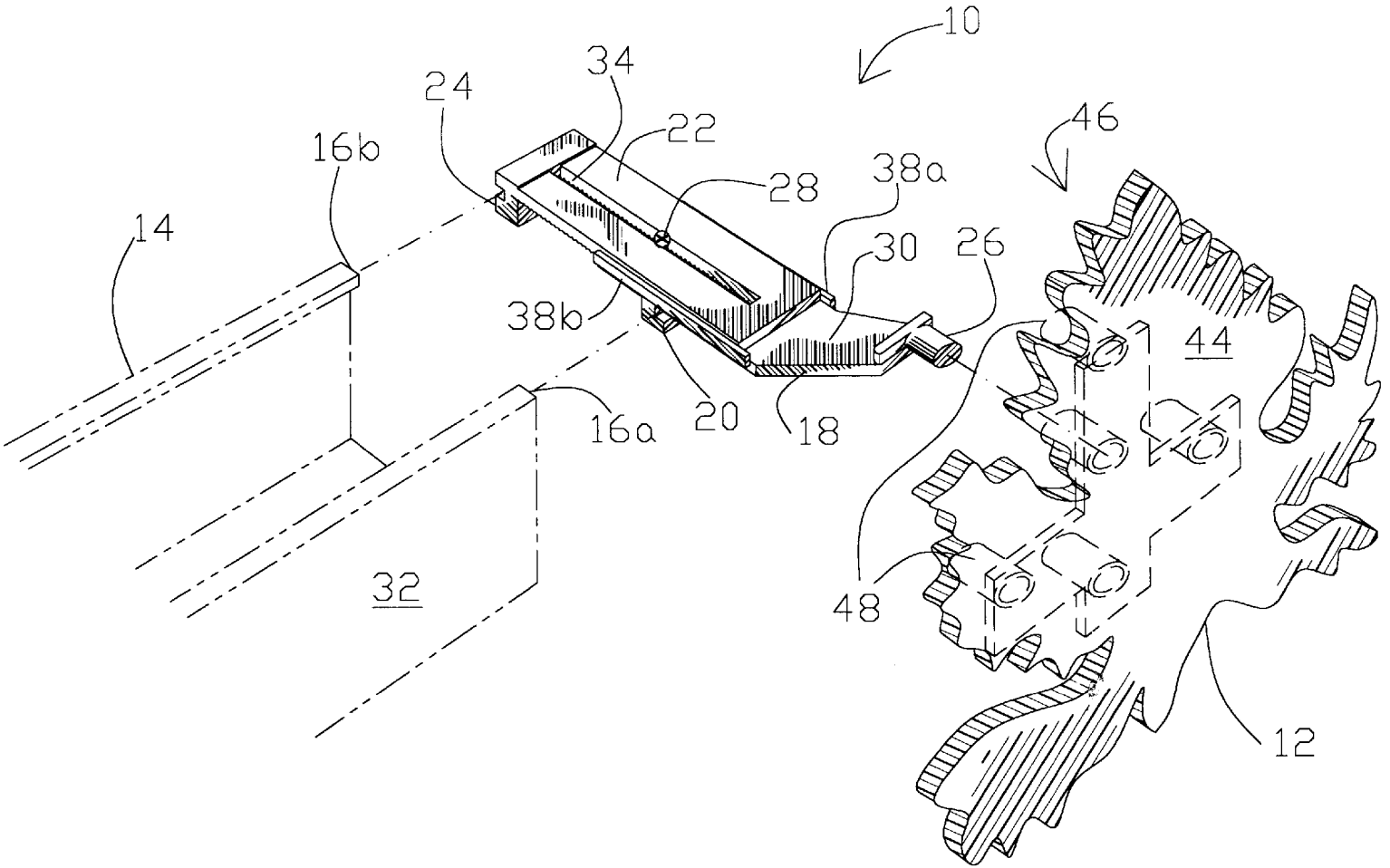
FIG. 1 is a perspective view of an adjustable bracket and finial apparatus in accordance with the present invention, along with a headrail shown in phantom.
Figure 3:
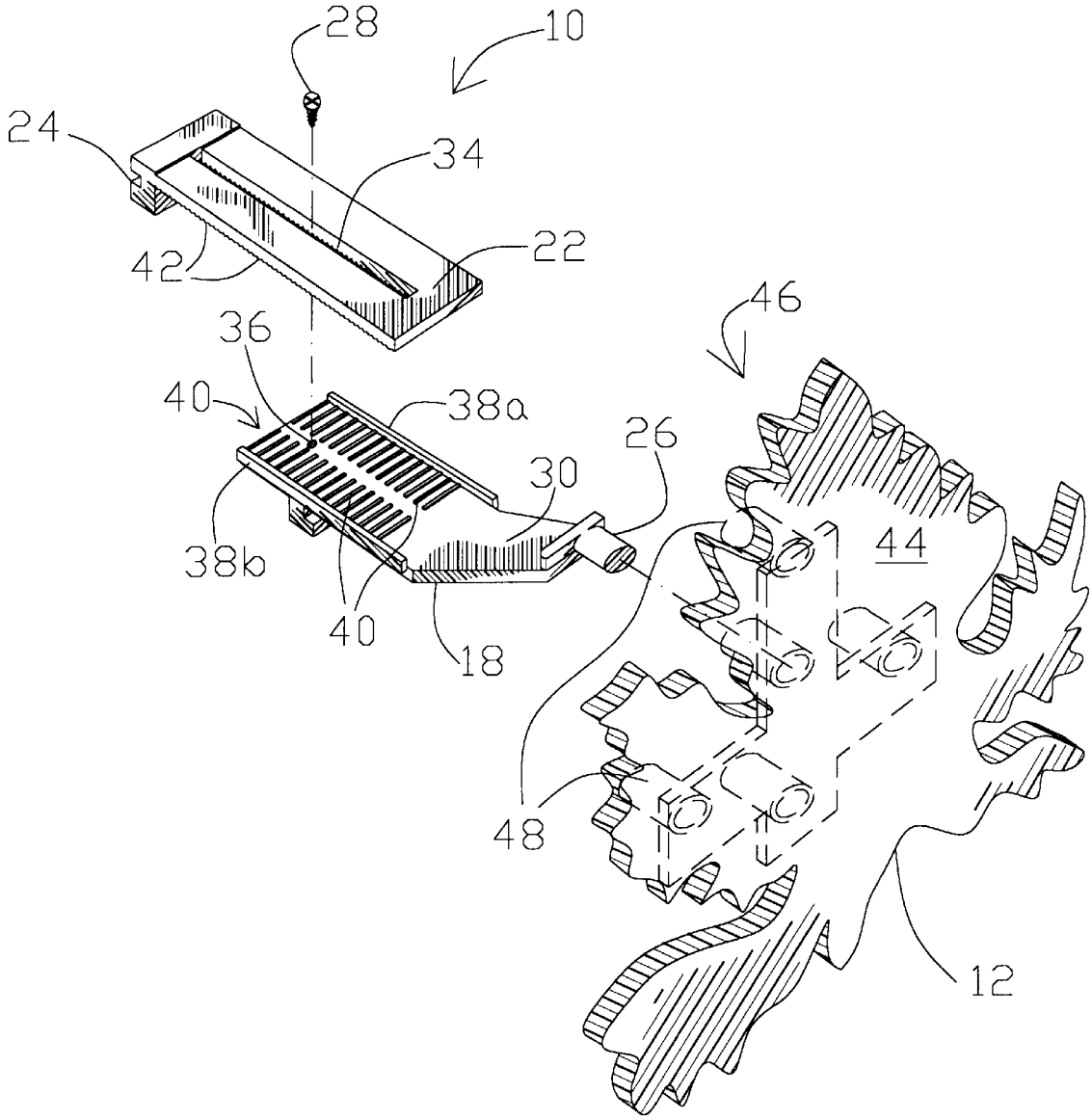
FIG. 3 is an exploded view of the adjustable bracket shown in FIG. 1.

Referring more specifically to the drawings, for illustrative purposes the present invention is embodied in the apparatus generally shown in FIG. 1 though FIG. 3. It will be appreciated that the apparatus may vary as to configuration and as to details of the parts without departing from the basic concepts as disclosed herein.

Figure 2:
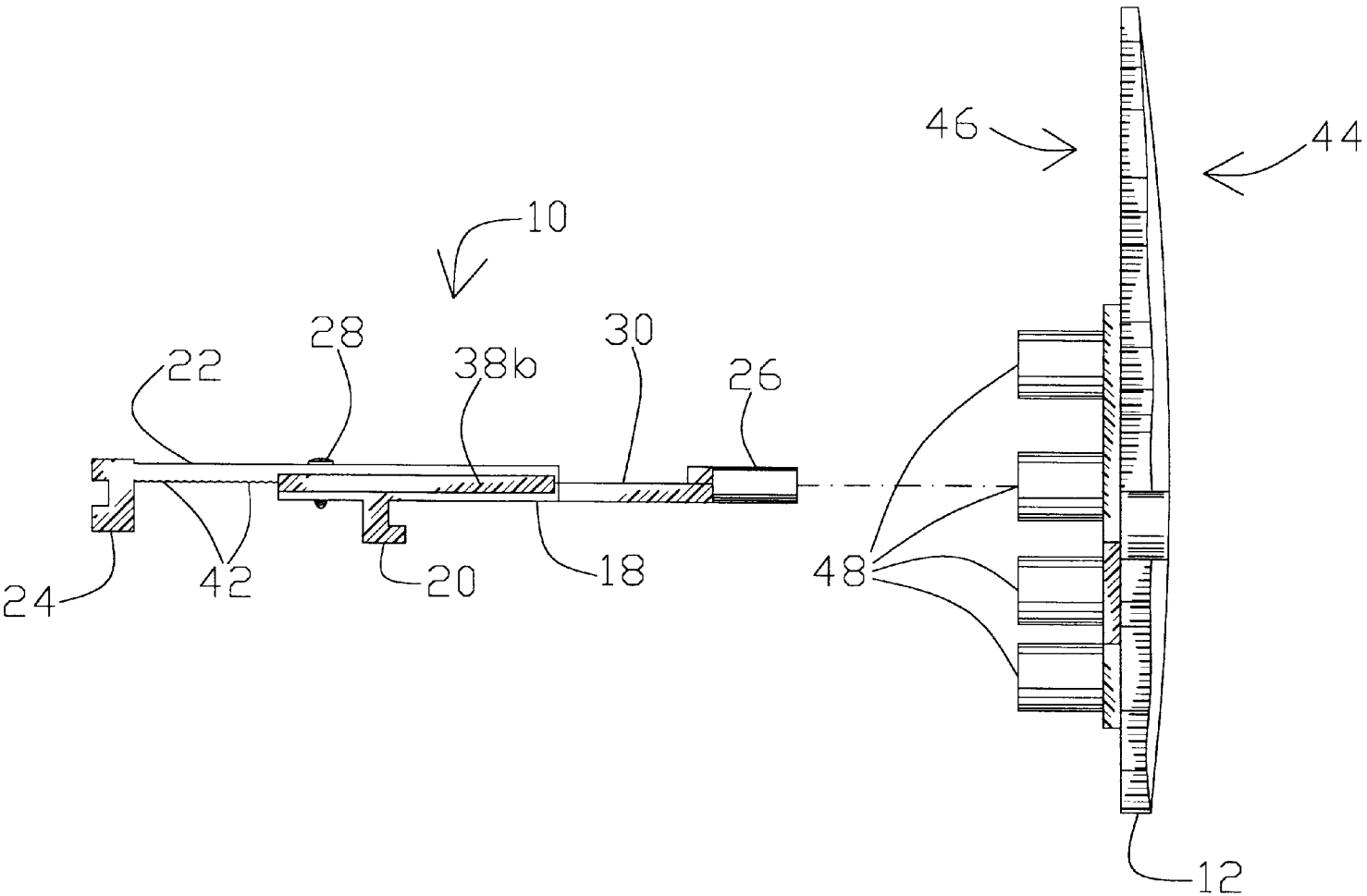
FIG. 2 is a side elevational view of the adjustable bracket shown in FIG. 1.

Referring to FIG. 1 through FIG. 3, an apparatus 10 for mounting a decorative finial 12, in accordance with the present invention, is generally shown. Apparatus 10 is adapted for attachment onto a headrail 14 for miniblinds, draperies, curtains, or the like, wherein headrail 14 typically incorporates a pair of inwardly facing lips 16*a* and 16*b* thereon. Apparatus 10 generally comprises a first bracket 18, a first flange 20, a second bracket 22, a second flange 24, a knob 26, and a screw 28.

First flange 20 extends outwardly from first bracket 18 and is adapted to engage lip 16*a* of headrail 14. Second flange 24 extends outwardly from second bracket 22 and is adapted to engage lip 16*b* of headrail 14. Knob 26 preferably protrudes from first bracket 18 through an arm 30, and knob 26 is adapted to receive decorative finial 12 that may be attached thereto. Those skilled in the art will appreciate that knob 26 may alternatively protrude from second bracket 22.

Regardless of whether knob 26 protrudes from either first bracket 18 or second bracket 22, the direction knob 26 is oriented must be on the display side 32 of headrail 14. It can be seen that when first flange 20 and second flange 24 are simultaneously engaged onto first lip 16*a* and second lip 16*b*, respectively, of headrail 14, apparatus 10 is thereby securely attached to headrail 14. Arm 30 provides a perch upon which a curtain or drapery (not shown) may be looped such that continuous looped swagged appearance may be created through use of a multiple apparatus 10 arrangements.

In order to accommodate varying sizes of headrail 14, and hence, varying distances that separate lips 16*a* and 16*b* of headrail 14, apparatus 10 incorporates adjustment capability. This adjustment capability is accomplished wherein second bracket 22 incorporates a slot 34 disposed longitudinally thereon, a hole 36 in first bracket 18, and screw 28. Slot 34 passes completely through first bracket 18. Second bracket 22 is positioned over first bracket 18 such that hole 36 of first bracket 18 coincides with slot 34 of second bracket 22. Screw 28 is inserted through slot 34 and threads into hole 36, thereby compressing first bracket 18 and second bracket 22 together. When screw 28 is securely tightened, first bracket 18 and second bracket 22 are maintained in a fixed position with respect to each other, and loosening screw 28 allows first bracket 18 to move with respect to second bracket 22.

In order to provide relatively linear movement of first bracket 18 and second bracket 22 during adjustment, first bracket 18 incorporates a pair of side rails 38*a* and 38*b*. It can be seen that side rails 38*a* and 38*b* of first bracket 18 define a channel 40 along which second bracket 22 traverses. As such, side rails 38*a* and 38*b* help prevent either first bracket 18 or second bracket 22 from twisting horizontally when screw 28 is loosened. Those skilled in the art will appreciate that side rails 38*a* and 38*b* may instead be incorporated on second bracket 22 in order to accomplish the same purpose.

As an additional feature that functions in conjunction with the adjustment capability of apparatus 10, apparatus 10 also comprises a detent mechanism. The detent mechanism comprises a plurality of laterally-disposed corrugations 41 on first bracket 18 and a plurality of corresponding laterally-disposed corrugations 42 on second bracket 22. Corrugations 41 on first bracket 18 and corresponding laterally-disposed corrugations 42 on second bracket 22 arc positioned on intersecting surfaces of first bracket 18 and second bracket 22, respectively, to engage each other in a friction/slip arrangement. This detent mechanism therefore more effectively locks both first bracket 18 and second bracket 22 together when screw 28 is tightened, which increases the holding strength of apparatus 10 against headrail 14.

Finial 12 typically embodies a decorative item on its display side 44, such as a leaf, as shown, or otherwise a like imitation thereof. The non-display side 46 of finial 12 include a plurality of bosses 48 that are adapted to fit over knob 26 of apparatus 10. The varying position of bosses 48 on non-display side 46 of apparatus 10 provide for aesthetic flexibility in the placement of finial 12 on apparatus 10.

Accordingly, it will be seen that this invention provides for the attachment of a finial onto an adjustable bracket assembly that is adaptable to be mounted onto a variety of headrails of varying sizes. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for attachment onto a headrail having a pair of horizontally opposed lips, comprising:

a finial having a display side and a non-display side, said non-display side having a plurality of bosses;

a first bracket having a plurality of laterally-disposed corrugations, and a first flange means for engaging the lip of the headrail;

a second bracket having a plurality of laterally-disposed corrugations, a second flange means for engaging the lip of the headrail, and a slot opening through said second bracket;

a screw for inserting through said slot at a selected location along said slot such that said laterally-disposed corrugations of said first bracket mesh with said laterally-disposed corrugations of said second bracket in a detent relationship;

a threaded means for receiving said screw such that as the screw is tightened said first bracket is compressed against said second bracket and;

a knob protruding from said first or second bracket, said knob inserted into a selected boss of said finial whereby said finial may be mounted in various positions with respect to the headrail.

2. An apparatus as recited in claim 1, wherein said first bracket includes side rails which form a channel and said second bracket is inserted between the channel.

3. An apparatus as recited in claim 1, wherein said second bracket includes side rails which form a channel and said first bracket is inserted between the channel.

4. The apparatus as recited in claim 1, wherein said first bracket includes an arm and said knob protrudes from said arm.

5. The apparatus as recited in claim 1, wherein said second bracket includes an arm and said knob protrudes from said arm.

* * * * *